US009617493B2

(12) United States Patent
Crawley et al.

(10) Patent No.: US 9,617,493 B2
(45) **Date of Patent: *Apr. 11, 2017**

(54) INTERNAL COMBUSTION ENGINE LUBRICANT

(71) Applicant: The Lubrizol Corporation, Wickliffe, OH (US)

(72) Inventors: Seth L. Crawley, Mentor, OH (US); Jody A. Kocsis, Chagrin Falls, OH (US); Suzanne M. Patterson, Seven Hills, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/524,025

(22) Filed: Oct. 27, 2014

(65) Prior Publication Data

US 2015/0045267 A1 Feb. 12, 2015

Related U.S. Application Data

(63) Continuation of application No. 13/319,341, filed as application No. PCT/US2010/033474 on May 4, 2010, now Pat. No. 8,901,051.

(60) Provisional application No. 61/177,752, filed on May 13, 2009.

(51) Int. Cl.

| | |
|---|---|
| ***C10M 133/16*** | (2006.01) |
| ***F16C 33/20*** | (2006.01) |
| ***F01M 9/10*** | (2006.01) |
| ***C10M 133/44*** | (2006.01) |

(52) U.S. Cl.

CPC ..... *C10M 133/44* (2013.01); *C10M 133/16* (2013.01); *C10M 2207/028* (2013.01); *C10M 2207/24* (2013.01); *C10M 2207/262* (2013.01); *C10M 2207/281* (2013.01); *C10M 2207/282* (2013.01); *C10M 2207/289* (2013.01); *C10M 2215/02* (2013.01); *C10M 2215/04* (2013.01); *C10M 2215/082* (2013.01); *C10M 2215/086* (2013.01); *C10M 2215/223* (2013.01); *C10M 2215/224* (2013.01); *C10M 2219/046* (2013.01); *C10M 2219/068* (2013.01); *C10M 2219/089* (2013.01); *C10M 2223/043* (2013.01); *C10M 2223/045* (2013.01); *C10N 2230/06* (2013.01); *C10N 2230/12* (2013.01); *C10N 2230/42* (2013.01); *C10N 2230/43* (2013.01); *C10N 2230/45* (2013.01); *C10N 2240/10* (2013.01)

(58) Field of Classification Search

CPC . F16C 33/201; C10M 2215/086; F01M 11/02
USPC ..... 508/100, 290; 123/196 R
See application file for complete search history.

(56) References Cited

U.S. PATENT DOCUMENTS

| | | | |
|---|---|---|---|
| 2,977,309 | A | 3/1961 | Godfrey et al. |
| 4,237,022 | A | 12/1980 | Barrer et al. |
| 4,326,972 | A | 4/1982 | Chamberlin, III et al. |
| 4,952,328 | A | 8/1990 | Davis et al. |
| 5,338,470 | A | 8/1994 | Hiebert et al. |
| 5,554,768 | A | 9/1996 | Dönges et al. |
| 6,437,009 | B1 | 8/2002 | Meier et al. |
| 2010/0048437 | A1 | 2/2010 | Brown et al. |

FOREIGN PATENT DOCUMENTS

| | | |
|---|---|---|
| EP | 1642954 | 4/2006 |
| WO | 2005087904 | 9/2005 |
| WO | 2006044411 | 4/2006 |
| WO | 2008147704 | 12/2008 |
| WO | 2010039509 | 4/2010 |
| WO | 2010132318 | 11/2010 |
| WO | 2010132320 | 11/2010 |

*Primary Examiner* — Vishal Vasisth

(74) *Attorney, Agent, or Firm* — Iken S. Sans; Teresan W. Gilbert

(57) ABSTRACT

The invention provides a composition containing an oil of lubricating viscosity and an N-substituted malimide. The invention further relates to the use of the lubricating composition in an internal combustion engine.

21 Claims, No Drawings

INTERNAL COMBUSTION ENGINE LUBRICANT

This application is a CON of Ser. No. 13/319,341, filed Jan. 5, 2012, now U.S. Pat. No. 8,901,051 which is a 371 of PCT/US2010/033474, filed May 4, 2010 which claims benefit of 61/177,752, filed May 13, 2009.

FIELD OF INVENTION

The invention provides a composition containing an oil of lubricating viscosity and an N-substituted malimide. The invention further relates to the use of the lubricating composition in an internal combustion engine.

BACKGROUND OF THE INVENTION

It is well known for lubricating oils to contain a number of surface active additives (including antiwear agents, dispersants, or detergents) used to protect internal combustion engines from wear, soot deposits and acid build up. Often, such surface active additives can have harmful effects on bearing corrosion or friction performance. As friction increases, fuel economy tends to decrease. A common antiwear additive for engine lubricating oils is zinc dialkyldithiophosphate (ZDDP). The addition of known friction modifiers (such as glycerol monooleate or oleyl tartrimide), is believed to balance or lower the coefficient of friction. However, friction modifiers may have deleterious effects as well as competing with the antiwear agent or bearing corrosion inhibitor (typically bearings containing lead and copper).

Various attempts have been made to reduce corrosion caused by ashless additives. These attempts include those disclosed in references described below. In general terms the references describe a variety of additives derived from a carboxylic acid, or a hydroxy-carboxylic acid.

U.S. Pat. No. 5,338,470 discloses alkylated citric acid derivatives obtained as a reaction product of citric acid and an alkyl alcohol or amine. The alkylated citric acid derivative is effective as a friction modifier.

U.S. Pat. No. 4,237,022 discloses tartrimides useful as additives in lubricants and fuels for effective reduction in squeal and friction as well as improvement in fuel economy.

U.S. Pat. No. 4,952,328 discloses lubricating oil compositions for internal combustion engines, comprising (A) oil of lubricating viscosity, (B) a carboxylic derivative produced by reacting a succinic acylating agent with certain amines, and (C) a basic alkali metal salt of sulphonic or carboxylic acid.

U.S. Pat. No. 4,326,972 discloses lubricant compositions for improving fuel economy of internal combustion engines. The composition includes a specific sulphurised composition (based on an ester of a carboxylic acid) and a basic alkali metal sulphonate.

U.S. Patent Application 60/862534 (PCT/US07/082057) discloses malonate esters.

International Publication WO 2005/087904 discloses lubricants containing hydroxy carboxylic acid and hydroxy polycarboxylic acid esters in combination with phosphorus-containing additives. The hydroxy polycarboxylic acid esters include tartaric acid and citric acid.

International Publication WO 2006/044411 discloses a low-sulphur, low-phosphorus, low-ash lubricant composition containing a tartrate ester, or amide having 1 to 150 carbon atoms per ester of amide group. The lubricant composition is suitable for lubricating an internal combustion engine.

EP 1 642 954 discloses a fluid composition comprising at least one hydroxy-substituted carboxylic acid. The hydroxy-substituted carboxylic acid provides at least one property chosen from rust inhibition, corrosion inhibition, improved lubricity, and improved lead compatibility. The hydroxy-substituted carboxylic acid is typically selected from hydroxycinnamic acid, 3-(4-hydroxyphenyl)propionic acid, 6-hydroxycaproic acid, 2-hydroxycinnamic acid, and 3-(2-hydroxyphenyl)propionic acid. Furthermore the composition disclosed therein is described as suitable for use in a transmission fluid. The transmission fluid is used an automatic transmission, continuous variable transmission, and/or a manual transmission.

SUMMARY OF THE INVENTION

The inventors of this invention have discovered that a lubricating composition and method as disclosed herein may be capable of providing acceptable levels of at least one of (i) lead corrosion inhibiting performance, and (ii) friction control (resulting in increased in fuel economy).

In one embodiment the invention provides a lubricating composition comprising an oil of lubricating viscosity and an N-substituted malimide, or mixtures thereof.

In one embodiment the invention provides a method of lubricating an internal combustion engine comprising supplying to the internal combustion engine a lubricating composition comprising an oil of lubricating viscosity and an N-substituted malimide, or mixtures thereof.

In one embodiment the invention provides for the use of an N-substituted malimide in an engine lubricant to provide at least one of fuel economy (typically increasing fuel economy), friction control or control of lead corrosion (typically by reducing or minimizing lead corrosion). In one embodiment the use of the N-substituted malimide in an engine lubricant provides both a benefit in fuel economy and in reducing or minimizing lead corrosion.

DETAILED DESCRIPTION OF THE INVENTION

The present invention provides a lubricating composition and method as disclosed herein above.

N-Substituted Malimide

As used herein the term "alk(en)yl" includes both alkyl and alkenyl groups.

The lubricating composition disclosed herein contains an N-substituted malimide (may also be referred to as a malimide), or mixtures thereof. The N-substituted malimide has an N-hydrocarbyl substituent group which may be an alk(en)yl group. The alk(en)yl group may contain 1 to 30, or 8 to 20 carbon atoms, with the proviso that when the N-substituted malimide comprises molecules with a hydrocarbyl group of less than 8 carbon atoms, then the N-substituted malimide is in the form of a mixture of N-substituted malimides and the hydrocarbyl groups in said mixture have an average total number of carbon atoms of at least 6, or at least 10.

The N-substituted hydrocarbyl malimide may be represented by formula (1) or formula (2) as described herein. Typically the N-substituted hydrocarbyl malimide may be represented by formula (1).

In one embodiment the N-substituted hydrocarbyl malimide may be represented by formula (1):

formula (1)

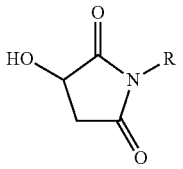

wherein R may be a linear, branched or cyclic hydrocarbyl group (typically a linear or branched hydrocarbyl group) containing 1 to 30, or 8 to 20 carbon atoms, with the proviso that when the N-substituted malimide comprises molecules with a hydrocarbyl group of less than 8 carbon atoms, then the N-substituted malimide is in the form of a mixture of N-substituted malimides and the hydrocarbyl groups in said mixture have an average total number of carbon atoms of at least 6, or at least 7, or at least 10.

In one embodiment the R hydrocarbyl group may include an alkyl group such as 2-ethylhexyl, nonyl, decyl, undecyl, dodecyl, tridecyl, tetradecyl, pentadecyl, hexadecyl, heptadecyl, octadecyl, nonadecyl, eicosyl, or mixtures thereof.

When the R hydrocarbyl group is an alkenyl group examples include cis and trans including 8-octadecenyl, 9-octadecenyl, 10-octadecenyl, 8-hexadecenyl, 9-hexadecenyl, 10-hexadecenyl, 8-eicosenyl, 9-eicosenyl, 10-eicosenyl, or mixtures thereof.

In one embodiment the R hydrocarbyl group may include oleyl(cis-9-octadecenyl), coco, tallow, lauryl, stearyl, or mixtures thereof. N-substituted hydrocarbyl malimide compounds having these R groups may be named as N-substituted oleyl malimide, N-substituted coco malimide, N-substituted tallow malimide, N-substituted lauryl malimide and N-substituted stearyl malimide.

The N-substituted hydrocarbyl malimide may be prepared by a process comprising reacting a primary amine with malic acid or esters thereof. The primary amine has an alk(en)yl group typically containing 1 to 30, 6 to 30, or 8 to 20 carbon atoms.

Examples of a primary amine may be selected from the category of amines which may be generally described as substituted hydrocarbyl amines. The hydrocarbyl group of the amine, that is, a hydrocarbyl group attached to the, or attached to an, amino nitrogen, may be described as a long chain hydrocarbyl group, by which is meant generally a hydrocarbyl group containing 8 to 30, or 8 to 20, or 12 to 22 carbon atoms. The hydrocarbyl group may include a mixture of individual groups on different molecules having a variety of carbon numbers falling generally within the range of 8 to 30, or 8 to 20, or 12 to 20 carbon atoms, although molecules with hydrocarbyl groups falling outside this range may also be present. If a mixture of hydrocarbyl groups is present, they may be primarily of even carbon number (e.g., 12, 14, 16, 18, 20, 22) as is characteristic of groups derived from many naturally-occurring materials, or they may be a mixture of even and odd carbon numbers or, alternatively, an odd carbon number or a mixture of odd numbers. They may be branched, linear, or cyclic and may be saturated or unsaturated, or combinations thereof. In certain embodiments the hydrocarbyl groups may contain 16 to 18 carbon atoms, and sometimes predominantly 16 or predominantly 18. Specific examples include mixed "coco" groups from cocoamine (predominantly C12 and C14 amines) and mixed "tallow" groups from tallowamine (predominantly C16 and C18 groups), and isostearyl groups.

The reaction of the primary amine with malic acid or esters may be performed in a variety of different reaction conditions. The reaction may be carried out at a reaction temperature in the range of 50° C. to 200° C., or 120° C. to 180° C., or 130° C. to 170° C. The reaction may be carried out in an inert atmosphere e.g., under nitrogen, or argon, typically nitrogen. The reaction may be performed in the presence or absence of a solvent (typically including a solvent). The solvent includes or may include an aromatic hydrocarbon solvent.

Examples of a aromatic hydrocarbon solvent include aromatic hydrocarbon solvent include Shellsolv AB® (commercially available from Shell Chemical Company); and toluene extract, xylene Aromatic 200, Aromatic 150, Aromatic 100, Solvesso 200, Solvesso 150, Solvesso 100, HAN 857® all commercially available from Exxon Chemical Company or mixtures thereof. Other aromatic hydrocarbon solvents include xylene, toluene, or mixtures thereof.

In one embodiment the lubricating composition disclosed herein contains a N(N,N'-dihydrocarbylaminoalkyl)malimide, or mixtures thereof.

In one embodiment the N(N',N'-dihydrocarbylaminoalkyl)malimide may be represented by formula (2):

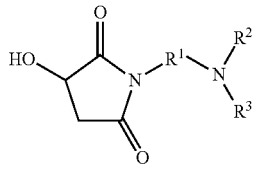

wherein $R^1$ may be a hydrocarbylene typically containing 1 to 6, 1 to 4, 2 to 3 or 3 carbon atoms; and $R^2$ and $R^3$ may be hydrogen or a hydrocarbyl group (such as a linear, branched or cyclic hydrocarbyl group containing 1 to 30, or 8 to 20 carbon atoms (typically the hydrocarbyl group may be linear or branched);

with the proviso that when the N-substituted malimide comprises molecules with a hydrocarbyl group of less than 8 carbon atoms, then the N-substituted malimide is in the form of a mixture of N-substituted malimides and the hydrocarbyl groups in said mixture have an average total number of carbon atoms of at least 6, or at least 7, or at least 10, and with the proviso that $R^2$ and $R^3$ are not simultaneously both hydrogen.

In one embodiment the N(N',N'-dihydrocarbylaminoalkyl)malimide of formula (2) has both $R^2$ and $R^3$ defined as a hydrocarbyl group (typically the same hydrocarbyl group e.g., $R^2$ and $R^3$ are both lauryl, or both stearyl, or both coco, or both tallow).

The N(N',N'-dihydrocarbylaminoalkyl)malimide may be prepared by a process comprising reacting malic acid or esters with an amine represented by the formula:

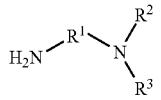

wherein $R^1$, $R^2$ and $R^3$ are defined above.

The amine may be a polyamine in the "Duomeen" series, available from Akzo Nobel. The polyamine may be prepared by the addition a monoamine $R^2R^3NH$ to acrylonitrile, followed by catalytic reduction of the resulting nitrile compound, using, e.g., $H_2$ over Pd/C catalyst, to give the diamine.

Examples of N(N',N'-dihydrocarbylaminoalkyl)malimide compounds include N(N',N'-dicocoaminopropyl)malimide, N(N',N'-dilaurylaminopropyl)-malimide, N(N',N'-dioleylaminopropyl)malimide, N(N',N'-distearylamino-propyl) malimide, N(N',N'-coco-tallowaminopropyl)malimide, N(N',N'-lauryl-oleylaminopropyl)malimide and N(N',N'-coco-stearylaminopropyl)malimide.

The reaction conditions (relating to reaction temperature, solvent, and atmosphere) to prepare the N-substituted 1-(2-dihydrocarbyl amino alkyl) malimide include a reaction temperature in the range of 50° C. to less than 140° C., or 90° C. to 135° C., or 100° C. to 130° C. The reaction may be carried out in an inert atmosphere e.g., under nitrogen, or argon, typically nitrogen. The reaction may be performed in the presence or absence of a solvent (typically including a solvent). The solvent may include an aromatic hydrocarbon solvent. The solvent may be similar to those listed above, except for the preparation of the N(N',N'-dihydrocarbylaminoalkyl)malimide where toluene is particularly useful.

The N-substituted malimide may be present in the lubricating composition in an amount in the range of 0.1 wt % to 5 wt %, or 0.2 wt % to 3 wt %, or greater than 0.2 wt % to 3 wt % of the lubricating composition.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056]. A more detailed description of natural and synthetic lubricating oils is described in paragraphs [0058] to [0059] respectively of WO2008/147704. Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". In one embodiment the oil of lubricating viscosity may be an API Group II or Group III oil.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Other Performance Additives

The composition optionally comprises other performance additives. The other performance additives include at least one of metal deactivators, viscosity modifiers, detergents, friction modifiers (in addition to the N-substituted malimide of the present invention), antiwear agents, corrosion inhibitors, dispersants, dispersant viscosity modifiers, extreme pressure agents, antioxidants, foam inhibitors, demulsifiers, pour point depressants, seal swelling agents and mixtures thereof. Typically, fully-formulated lubricating oil will contain one or more of these performance additives.

In one embodiment the lubricating composition further includes other additives. In one embodiment the invention provides a lubricating composition further comprising at least one of an antiwear agent, a dispersant, a dispersant viscosity modifier, a friction modifier, a viscosity modifier, an antioxidant, an overbased detergent, or mixtures thereof.

In one embodiment the lubricating composition of the invention further comprises a dispersant viscosity modifier. The dispersant viscosity modifier may be present at 0 wt % to 5 wt %, or 0 wt % to 4 wt %, or 0.05 wt % to 2 wt % of the lubricating composition.

The dispersant viscosity modifier may include functionalised polyolefins, for example, ethylene-propylene copolymers that have been functionalized with an acylating agent such as maleic anhydride and an amine; polymethacrylates functionalised with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. In one embodiment the dispersant viscosity modifier may include those described in U.S. Pat. No. 4,863,623 (see column 2, line 15 to column 3, line 52) or in International Publication WO2006/015130 (see page 2, paragraph [0008]).

The dispersant viscosity modifier of U.S. Pat. No. 4,863,623 may be described as being prepared by grafting of an olefinic carboxylic acid acylating agent onto a polymer of 15 to 80 mole percent of ethylene, from 20 to 85 mole percent of $C_{3-10}$ alpha monoolefin, and from 0 to 15 mole percent of non-conjugated diene or triene, said polymer having an average molecular weight ranging from 5000 to 500,000, and further reacting said grafted polymer with an amine. The polymer is reacted with at least one olefinic carboxylic acid acylating agent to form one or more acylating reaction intermediates having a carboxylic acid acylating function and the additive is formed by reacting said reaction intermediate with an amine such as an amino-aromatic polyamine compound selected from an N-arylphenylenediamine, an aminothiazole, an aminocarbazole, an aminoindole, and aminopyrrole, an amino-indazolinone, an aminomercaptotriazole, and an aminopyrimidine.

The dispersant viscosity modifier of International Publication WO2006/015130 may be described as a reaction product of: (a) a polymer comprising carboxylic acid functionality or a reactive equivalent thereof, said polymer having a number average molecular weight of greater than 5,000; and (b) an amine component comprising at least one aromatic amine containing at least one amino group capable of condensing with said carboxylic acid functionality to provide a pendant group and at least one additional group comprising at least one nitrogen, oxygen, or sulfur atom, wherein said aromatic amine is selected from the group consisting of (i) a nitro-substituted aniline, (ii) amines comprising two aromatic moieties linked by a —C(O)NR— group, a —C(O)O— group, an —O— group, an —N═N— group, or an —$SO_2$— group where R is hydrogen or hydrocarbyl, one of said aromatic moieties bearing said condensable amino group, (iii) an aminoquinoline, (iv) an aminobenzimidazole, (v) an N,N-dialkylphenylenediamine, and (vi) a ring-substituted benzylamine. Typically the polymer of WO2006/015130 may be an ethylene-propylene copolymer or a copolymer of ethylene and a higher olefin, wherein the higher olefin is an alpha-olefin having 3 to 10 carbon atoms. The dispersant viscosity modifier of International Publication WO2006/015130 is prepared as disclosed in paragraphs [0065] to [0073] (these paragraphs relate to examples 1 to 9).

In one embodiment the invention provides a lubricating composition which further includes a phosphorus-containing antiwear agent. Typically the phosphorus-containing antiwear agent may be a zinc dialkyldithiophosphate, or mixtures thereof. Zinc dialkyldithiophosphates are known in the art. The antiwear agent may be present at 0 wt % to 5 wt %, or 0.1 wt % to 3 wt %, or 0.5 wt % to 2 wt % of the lubricating composition.

In one embodiment the invention provides a lubricating composition further comprising a molybdenum compound. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 5 to 1000 ppm, or 10 to 750 ppm 5 ppm to 300 ppm, or 20 ppm to 250 ppm of molybdenum. The molybdenum compound may perform as a friction modifier, or an antioxidant.

In one embodiment the invention provides a lubricating composition further comprising an overbased detergent. The overbased detergent may be selected from the group consisting of non-sulphur containing phenates, sulphur containing phenates, sulphonates, salixarates, salicylates, and mixtures thereof. Typically an overbased detergent may be a sodium, calcium or magnesium salt of the phenates, sulphur containing phenates, sulphonates, salixarates and salicylates. Overbased phenates and salicylates, typically have a total base number of 180 to 450 TBN. Overbased sulphonates typically have a total base number of 250 to 600, or 300 to 500. Overbased detergents are known in the art. In one embodiment the sulphonate detergent may be a predominantly linear alkylbenzene sulphonate detergent having a metal ratio of at least 8 as is described in paragraphs [0026] to [0037] of US Patent Application 2005065045 (and granted as U.S. Pat. No. 7,407,919). The predominantly linear alkylbenzene sulphonate detergent may be particularly useful for assisting in improving fuel economy. The overbased detergent may be present at 0 wt % to 15 wt %, or 0.1 wt % to 10 wt %, or 0.2 wt % to 8 wt % of the lubricating composition.

Dispersant

The dispersant of the present invention may be a succinimide dispersant, or mixtures thereof. In one embodiment the dispersant may be present as a single dispersant. In one embodiment the dispersant may be present in a mixture of two or three different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetraethylenepentamine, pentaethylenehexamine, polyamine still bottoms, and mixtures thereof.

The dispersant may be a N-substituted long chain alkenyl succinimide. Examples of N-substituted long chain alkenyl succinimide include polyisobutylene succinimide. Typically the polyisobutylene from which the polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and U.S. Pat. Nos. 6,165,235, 7,238,650 and EP Patent Application 0 355 895 A.

The dispersant may also be post-treated by conventional methods by a reaction with any of a variety of agents. Among these are boron compounds, urea, thiourea, dimercaptothiadiazoles, carbon disulphide, aldehydes, ketones, carboxylic acids, hydrocarbon-substituted succinic anhydrides, maleic anhydride, nitriles, epoxides, and phosphorus compounds.

The dispersant may be present at 0 wt % to 12 wt %, or 0.75 wt % to 8 wt %, or 1 wt % to 6 wt % of the lubricating composition.

In one embodiment the lubricating composition includes an antioxidant, or mixtures thereof. The antioxidant may be present at 0 wt % to 15 wt %, or 0.1 wt % to 10 wt %, or 0.5 wt % to 5 wt % of the lubricating composition.

Antioxidants include sulphurised olefins, alkylated diphenylamines (typically dinonyl diphenylamine, octyl diphenylamine, dioctyl diphenylamine), hindered phenols, molybdenum compounds (such as molybdenum dithiocarbamates), or mixtures thereof.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of suitable other friction modifiers include fatty acid derivatives of amines, esters, or epoxides; fatty imidazolines such as condensation products of carboxylic acids and polyalkylene-polyamines; amine salts of alkylphosphoric acids; fatty alkyl tartrates; fatty alkyl tartrimides; or fatty alkyl tartramides.

Friction modifiers may also encompass materials such as sulphurised fatty compounds and olefins, molybdenum dialkyldithiophosphates, molybdenum dithiocarbamates, sunflower oil or monoester of a polyol and an aliphatic carboxylic acid.

As used herein the term "fatty" typically has at least 6 or at least 8 to 30, or 20 carbon atoms.

In one embodiment the friction modifier may be selected from the group consisting of fatty acid derivatives of amines, fatty esters, fatty epoxides, fatty imidazolines, amine salts of alkylphosphoric acids, fatty alkyl tartrates, fatty alkyl tartrimides, fatty alkyl tartramides, and mixtures thereof.

In one embodiment the friction modifier may be a fatty acid ester. In another embodiment the fatty acid ester may be a mono-ester and in another embodiment the long chain fatty acid ester may be a (tri)glycerides.

Other performance additives such as corrosion inhibitors include those described in paragraphs 5 to 8 of U.S. application Ser. No. 05/038,319, published as WO2006/047486, octylamine octanoate, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Metal deactivators including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides may be useful. Foam inhibitors that may be useful in the compositions of the invention include copolymers of ethyl acrylate and 2-ethylhexyl acrylate and optionally vinyl acetate; demulsifiers including trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene copolymers, poly(meth)acrylates, polyacrylates or polyacrylamides.

In different embodiments the lubricating composition may have a composition as described in the following table:

| | Embodiments (wt %) | | |
|---|---|---|---|
| Additive | A | B | C |
| N-Substituted Malimide | 0.1 to 5 | 0.2 to 3 | >0.2 to 3 |
| Dispersant | 0 to 12 | 0.75 to 8 | 1 to 6 |
| Dispersant Viscosity Modifier | 0 to 5 | 0 to 4 | 0.05 to 2 |
| Overbased Detergent | 0 to 15 | 0.1 to 10 | 0.2 to 8 |
| Antioxidant | 0 to 15 | 0.1 to 10 | 0.5 to 5 |
| Antiwear Agent | 0 to 15 | 0.1 to 10 | 0.5 to 5 |
| Friction Modifier | 0 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100% | Balance to 100% | Balance to 100% |

INDUSTRIAL APPLICATION

The lubricating composition may be utilised in an internal combustion engine. The internal combustion engine may or may not have an Exhaust Gas Recirculation system. The internal combustion engine may be fitted with an emission control system or a turbocharger. Examples of the emission control system include diesel particulate filters (DPF), or systems employing selective catalytic reduction (SCR).

In one embodiment the internal combustion engine may be a diesel fuelled engine (typically a heavy duty diesel engine), a gasoline fuelled engine, a natural gas fuelled engine or a mixed gasoline/alcohol fuelled engine. In one embodiment the internal combustion engine may be a diesel fuelled engine and in another embodiment a gasoline fuelled engine.

The internal combustion engine may be a 2-stroke or 4-stroke engine. Suitable internal combustion engines include marine diesel engines, aviation piston engines, low-load diesel engines, and automobile and truck engines.

In one embodiment the internal combustion engine contains iron or steel components, or aluminium-alloy components, or mixtures thereof. The iron components include steel, FeO, $Fe_3O_4$ or other materials containing iron. The aluminium-alloy includes aluminium silicates, aluminium oxides, or other ceramic materials. In one embodiment the aluminium-alloy is an aluminium-silicate surface. Typically the internal combustion engine contains iron components that may be lubricated with the lubricating composition disclosed herein.

The lubricant composition for an internal combustion engine may be suitable for any engine lubricant irrespective of the sulphur, phosphorus or sulphated ash (ASTM D-874). The sulphur content of the engine oil lubricant may be 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 100 ppm to 1000 ppm, or 200 ppm to 600 ppm. The total sulphated ash may be 2 wt % or less, or 1.5 wt % or less, or 1.1 wt % or less, or 1 wt % or less, or 0.8 wt % or less, or 0.5 wt % or less, or 0.4 wt % or less. In one embodiment the sulphated ash may be 0.05 wt % to 0.9 wt %, or 0.1 wt % to 0.2 wt % or to 0.45 wt %.

In one embodiment the lubricating composition may be an engine oil, wherein the lubricating composition may be characterised as having at least one of (i) a sulphur content of 0.5 wt % or less, (ii) a phosphorus content of 0.1 wt % or less, and (iii) a sulphated ash of 1.5 wt % or less.

The following examples provide illustrations of the invention. These examples are non-exhaustive and are not intended to limit the scope of the invention.

EXAMPLES

Preparative Example 1 (EX1)

Preparation of oleyl malimide. 175 g of malic acid and 131 g of xylene are added to a 4-necked one-liter round bottom flask equipped with a nitrogen inlet, mechanical stirrer, Dean-Stark apparatus, Friedrichs condenser and thermowell. The resultant mixture is heated to 140° C. and 349 g of oleyl amine is added dropwise over a period of 4 hours via an addition funnel. The flask is then maintained at 140° C. for a further 10 hours, before removal of 43 g of water. Solvent is then removed under vacuum (2.67 Pa, or 20 mm Hg) over a period of two hours at 140° C. The reaction produces 419 g of product.

Preparative Example 2 (EX2)

Preparation of coco-alkyl malimide. The process used as described in EX1 is followed, except 332 g of cocoamine is reacted with 216 g of malic acid. The reaction produces 449 g of product, and 52 g of water.

Preparative Example 3 (EX3)

Preparation of dodecyl malimide. The process used as described in EX1 is followed, except 298 g of dodecylamine is reacted with 216 g of malic acid. The reaction produces 426 g of product, and 52 g of water.

Preparative Example 4 (EX4)

Preparation of N—(N',N'-ditallow amino propyl) malimide. 74.5 g of malic acid and 250 $cm^3$ of toluene are added to a 4-necked one-liter round bottom flask equipped with a nitrogen inlet, mechanical stirrer, Dean-Stark apparatus, Friedrichs condenser and thermowell. The resultant mixture is heated to 110° C. and 324.3 g of Duomeen™2HT (N,N-ditallow propylenediamine) is added dropwise over a period of 6 hours via an addition funnel. The contents of the flask are stirred for a further 2 hours at 110° C. The flask is then heated to about 115° C. for at least 16 hours. Solvent is then removed under vacuum (2.67 Pa, or 20 mm Hg) over a period of two hours at 110° C.

Preparative Example 5 (EX5)

Preparation of N—(N',N'-dicoco amino propyl) malimide. The reaction is similar to EX4, except N,N-ditallow propylenediamine has been replaced with 238.6 g of N,N-dicoco propylenediamine.

SAE 5W-30 Engine Lubricant Compositions

A series of SAE 5W-30 engine lubricants (EL1 to EL5) are prepared containing 0.5 wt % of the product obtained in EX1 to EX5.

Comparative engine lubricant 1 (CEL1) is a SAE 5W-30 lubricant similar to EL1 to EL5 except no malimide is present (i.e, CEL1 does not contain a product of EX1 to EX5).

Comparative engine lubricant 2 (CEL2) is a SAE 5W-30 lubricant similar EL1 to EL5, except it contains 0.5 wt % of oleyl tartrimide.

Test 1: Friction Performance in HFRR

The SAE 5W-30 lubricants are evaluated for boundary lubrication friction performance in a programmed temperature high frequency reciprocating rig (HFRR) available from PCS Instruments. HFRR conditions for the evaluations are 200 g load, 75 minute duration, 1000 micrometer stroke, 20 Hertz frequency, and temperature profile of 15 minutes at 40° C. followed by an increase in temperature to 160° C. at a rate of 2° C. per minute. The upper test piece is a 6 mm diameter steel ball (ANSI E-52100, Rockwell 'C' hardness 58-66 and a surface finish of Ra<0.05 μm), the lower test specimen is a flat steel disc (ANSI E-52100, Vickers "HV30" hardness 190-210 and a surface finish of Ra<0.02 μm). Both the upper and lower specimens are available together from PCS Instruments (Part Number HFRSSP). The coefficient of friction is then measured. The coefficient of friction is calculated by dividing the measured friction force parallel to the direction of reciprocation by the load applied. The coefficient of friction results are obtained for CEL1, CEL2 and EL1 to EL3 and are presented in the Table below.

| Example | Friction Coefficient |
|---|---|
| CEL1 | 0.153 |
| CEL2 | 0.144 |
| EL1 | 0.139 |
| EL2 | 0.127 |
| EL3 | 0.126 |

The data presented indicates that the lubricating composition of the invention is able to reduce friction in an engine. The reduction in friction is also believed to assist in increasing fuel economy.

Test 2: Lead Corrosion

The 5W-30 engine lubricants are then evaluated for lead corrosion in lead corrosion test as defined in ASTM Method D6594-06. The amount of lead (Pb) in the oils at the end of test is measured and compared to the amount at the beginning of the test. Lower lead content in the oil indicates decreased lead corrosion. Overall results are obtained for each lubricant CEL1, CEL2 and EL1 to EL3 and are as follows:

| Example | Pb (ppm) |
|---|---|
| CEL1 | 21 |
| CEL2 | 34 |
| EL1 | 20 |
| EL2 | 25 |
| EL3 | 16 |

The data presented indicates that the presence of the N-substituted malimide in the invention lubricating compositions minimizes lead corrosion compared with a comparative example containing oleyl tartrimide.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising an oil of lubricating viscosity, 1 wt % to 6 wt % of a succinimide dispersant and 0.1 wt % to 5 wt % of an N-substituted malimide, and wherein the N-substituted malimide is represented by formula (1):

formula (1)

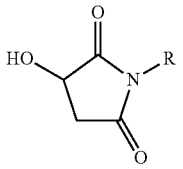

wherein R is a hydrocarbyl group containing 8 to 20 carbon atoms, and wherein the lubricating composition is characterised as having (i) a sulphur content of 0.5 wt % or less, (ii) a phosphorus content of 0.1 wt % or less, and (iii) a sulphated ash of 1.5 wt % or less.

2. The lubricating composition of claim 1 further comprising at least one of an antiwear agent, a dispersant viscosity modifier, a friction modifier, a viscosity modifier, an antioxidant, an overbased detergent, or mixtures thereof.

3. The lubricating composition of claim 2, wherein the friction modifier is selected from the group consisting of fatty acid derivatives of amines, fatty esters, fatty epoxides, fatty imidazolines, amine salts of alkylphosphoric acids, fatty alkyl tartrates, fatty alkyl tartrimides, fatty alkyl tartramides, and mixtures thereof.

4. The lubricating composition of claim 1 further comprising a dispersant viscosity modifier.

5. The lubricating composition of claim 1 further comprising a phosphorus-containing antiwear agent.

6. The lubricating composition of claim 1 further comprising an overbased detergent.

7. The lubricating composition of claim 6, wherein the overbased detergent is selected from the group consisting of phenates, sulphur containing phenates, sulphonates, salixarates, salicylates, and mixtures thereof.

8. The lubricating composition of claim 1 further comprising a molybdenum compound, wherein the molybdenum compound may be selected from the group consisting of molybdenum dialkyldithiophosphates, molybdenum dithiocarbamates, amine salts of molybdenum compounds, and mixtures thereof.

9. The lubricating composition of claim 1, wherein R is chosen from oleyl (cis-9-octadecenyl), coco, tallow, lauryl, stearyl, or mixtures thereof.

10. The lubricating composition of claim 1, wherein the N-substituted hydrocarbyl malimide compounds are chosen from N-substituted oleyl malimide, N-substituted coco malimide, N-substituted tallow malimide, N-substituted lauryl malimide and N-substituted stearyl malimide.

11. The lubricating composition of claim 1, wherein the succinimide dispersant is present as a single dispersant.

12. The lubricating composition of claim 1, wherein the succinimide dispersant is present in a mixture of two different dispersants, wherein at least one is a succinimide dispersant.

13. The lubricating composition of claim 1, wherein the succinimide dispersant is present in a mixture of three different dispersants, wherein at least one is a succinimide dispersant.

14. The lubricating composition of claim 1, wherein the succinimide dispersant is a polyisobutylene succinimide.

15. The lubricating composition of claim 14, wherein the polyisobutylene of the polyisobutylene succinimide has a number average molecular weight of 350 to 5000.

16. The lubricating composition of claim 14, wherein the polyisobutylene of the polyisobutylene succinimide has a number average molecular weight of 550 to 3000.

17. The lubricating composition of claim 14, wherein the polyisobutylene of the polyisobutylene succinimide has a number average molecular weight of 750 to 2500.

18. The lubricating composition of claim 1, wherein the succinimide dispersant is derived from an aliphatic polyamine, or mixtures thereof.

19. The lubricating composition of claim 1, wherein the aliphatic polyamine is an ethylenepolyamine, a propylenepolyamine, a butylenepolyamine, or mixtures thereof.

20. A method of lubricating an internal combustion engine comprising supplying to the internal combustion engine the lubricating composition of claim 1.

21. A method of reducing lead corrosion in an internal combustion engine comprising supplying to the internal combustion engine the lubricating composition of claim 1.

* * * * *